United States Patent [19]

Endo et al.

[11] Patent Number: 4,651,351

[45] Date of Patent: Mar. 24, 1987

[54] ESCAPEMENT GLOVE

[76] Inventors: Shigeharu Endo; Kazuma Endo; Kazuya Endo; Hiroko Itoh, all of 22-3, Motoshiro-cho, Fujinomiya-shi, Shizuoka-ken, Japan

[21] Appl. No.: 808,115

[22] Filed: Dec. 12, 1985

[30] Foreign Application Priority Data

Jan. 16, 1985 [JP] Japan ..... 60-3780[U]

[51] Int. Cl.[4] ..... A41D 19/00; A62B 1/20

[52] U.S. Cl. ..... 2/159; 2/167; 182/5; 182/129

[58] Field of Search ..... 182/3–7, 182/129; 188/65.1–65.5; 2/159, 167

[56] References Cited

U.S. PATENT DOCUMENTS

| | | | |
|---|---|---|---|
| 263,775 | 9/1882 | Emmert | 188/65.1 |
| 326,961 | 9/1885 | Engelke | 188/65.1 |
| 632,692 | 9/1899 | Boehme | 182/5 |
| 675,788 | 6/1901 | Oakley | 188/65.1 |
| 771,251 | 10/1904 | Howe | 188/65.4 |
| 1,413,690 | 4/1922 | Slocum | 188/65.4 |
| 1,509,552 | 9/1924 | Hardy | 188/65.3 |
| 2,301,843 | 11/1942 | Abdella | 188/65.1 |
| 3,861,497 | 1/1975 | Tsai | 182/5 |
| 4,574,398 | 3/1986 | Endo | 182/5 |

*Primary Examiner*—Reinaldo P. Machado
*Attorney, Agent, or Firm*—Holman & Stern

[57] ABSTRACT

A glove for escapement is disclosed, which is used for escapement along a rope at the time of occurrence of a fire or an earthquake. The glove comprises a glove body, a base member mounted on the palm side of the glove body and provided on the inner side with teeth, and a wing member having one edge pivoted to the base member and provided on the inner side with teeth capable of meshing with the teeth of the base member. The rope thus can be clamped in a meandering fashion between the teeth, and the user can smoothly slide down along the rope by reducing the clamping force applied to the rope.

3 Claims, 3 Drawing Figures

ESCAPEMENT GLOVE

BACKGROUND OF THE INVENTION

This invention relates to a glove for escapement which is used when escaping from a building along a rope at the time of occurrence of a fire or an earthquake.

High storey buildings are provided with ropes for escapement therealong to lower floors at the time of occurrence of an accident such as a fire or an earthquake. To slide down along a rope by gripping the rope with bare hands is very dangerous because of the friction produced between the rope and hands. For this reason, gloves are used for gripping the rope. A prior art glove of this kind has a heat insulation sheet or layer provided on the inner side, i.e., the palm side of the glove body. A substantially central portion of the heart insulation layer is provided with an engagement member, which is made of an elastic material having heart-insulation property and wear resistance and formed with a groove, in which an escapement rope is engaged. The wall surface of the groove formed in the engagement member is provided with an antislip member, thereby permitting safe escapement. However, since the anti-slip member is provided on the inner surface of the groove formed in the engagement member of the glove, it is difficult to smoothly slide down along the rope by bearing the gloves, but it is necessary to grip the rope strongly via the engagement member.

SUMMARY OF THE INVENTION

An object of the invention is to provide a glove for escapement, which can obviate the above drawback and permits the rope to be strongly clamped with a weak force, while permitting sliding down along the rope at a desired speed by reducing the force, with which the rope is clamped.

According to the invention, there is provided an escapement glove, which comprises a glove body, a base member mounted on the palm side of the glove body and provided on the inner side with teeth, and a wing member having one edge provided to the base member and provided on the inner side with teeth capable of meshing with the teeth of the base member. The rope thus can be clamped between the teeth of the base member and the teeth of the wing member. The user thus can smoothly slide down along the rope by reducing the clamping force applied to the rope. Quick escapement thus is possible by suitably adjusting the clamping force applied to the rope in case of emergency.

Further, with the escapement glove according to the invention the base member is provided adjacent to the upper and lower ends with rope guide rings corresponding to the teeth, so that the rope can be guided by the rope guide rings to a proper position of the engagement section in mesh with the teeth of the base member.

DETAILED DESCRIPTION OF THE PREFERRED EMBODIMENTS

Figure 1:
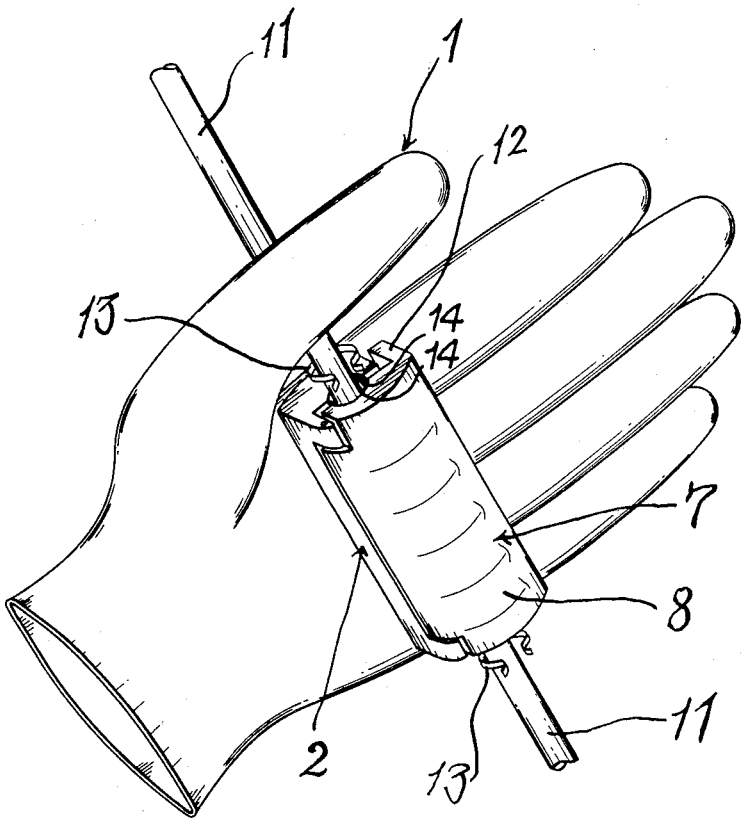
FIG. 1 is a perspective view showing a glove for escapement according to the invention.
Figure 2:
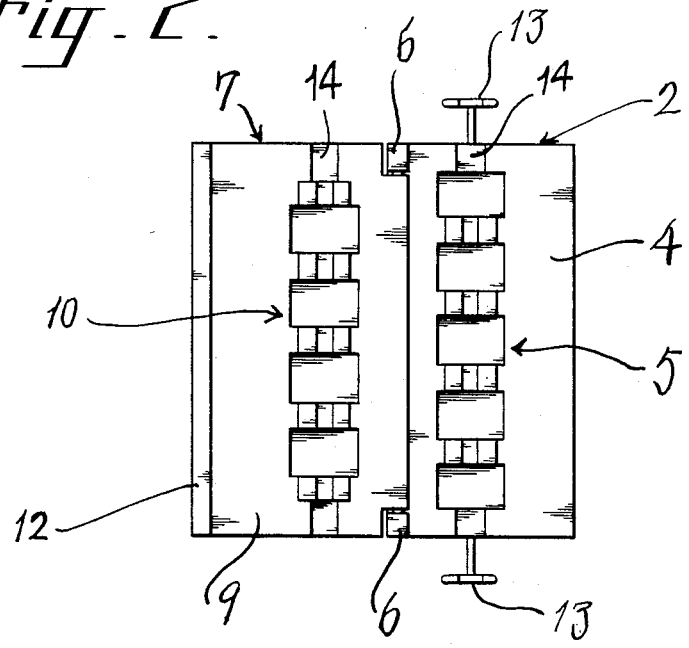
FIG. 2 is a plan view showing the glove with a base member and wing member expanded relative to each other.

Referring to the Figures, reference numeral 1 designates a glove body. A base member 2 is provided on the inner side, i.e., palm side, of the glove body. The base member 2 has a slightly curved underside 3, which is mounted on the glove body 1 and a top 4 which is formed with teeth 5 extending in the longitudinal direction. The top 4 of the base member 2 has projections 6 formed at the upper and lower ends of one edge. One edge of a wing member 7 having an L-shaped sectional profile, is pivoted to the base member 2. The wing member 7 can be pivoted to an open or expanded position as shown in FIG. 2, about one edge of the base member 2 from the overlapped state as shown in FIG. 1.

Figure 3:
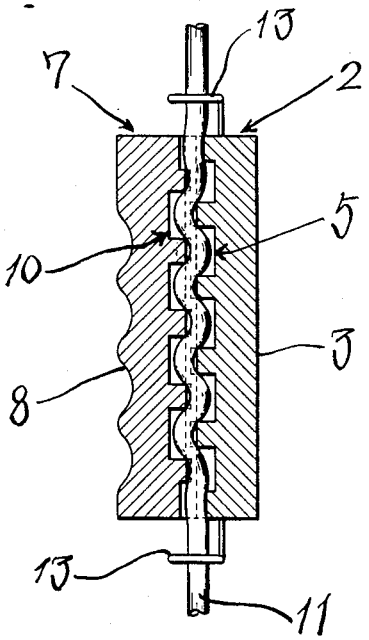
FIG. 3 is a longitudinal sectional view illustrating the mesh of teeth of the base member and wing member when the two members are overlapped.

The top of the wing member 7 is a curved grip surface 8. When the wing member 7 is overlapped over the base member 2, the wing and base members 7 and 2 have a cylindrical shape. The lower surface 9 of the wing member 7 has teeth 10 extending in the longitudinal direction, the teeth 10 being in mesh with the teeth 5 of the base member 2. As shown in FIG. 3, valley portions of the teeth 10 formed in the wing member 7 correspond to hill portions of the teeth 5 formed in the base member 2, and the hill portions of the teeth 10 correspond to the valley portions of the teeth 5. When the rope 11 is clamped between the base member 2 and wing member 7, the rope 11 is clamped in a meandering fashion between the teeth 5 and 10 of the base and wing members 2 and 7. The wing member 7 has a cover portion 12, which extends from one edge and overlaps over a corresponding edge of the base member 2 when the two members are overlapped to from a cylindrical shape.

The base 2 is provided adjacent to its upper and lower ends with rope guide rings 13 corresponding to the teeth 5 and 10. The rope 11 can be guided by the guide rings 13 so that it can be properly inserted in the mesh section constituted by the teeth 5 of the base member 2 and the teeth 10 of the wing member 7. A concave portion 14 is shown in FIGS. 1 and 2 which is generally concave in cross-section and which is adapted for positioning a rope in the center portion of the base 2 and in the center portion of the wing member 7.

The above construction of the invention has the following effectiveness. When an earthquake or fire accident occurs so that an available staircase leading to the lower floor can not longer be used, an escapement rope which is provided in each room is used with its one end attached to a suitable locality of the building. Then, the gloves according to the invention were fitted on the hands. Then the rope is suspended with the hands with the rope clamped between the base member 2 and wing member 7 of each glove. The rope is thus squeezed in a meandering fashion by the engaged teeth 5 and 10 of the base and wing menbers 2 and 7 provided on the inner side thereof. Thus, once the rope is gripped, the user can be suspended with a weak force applied to the rope. The user can smoothly slide down along the rope by adjusting the clamping force applied to the rope.

What is claimed is:

1. An escapement glove comprising a glove body, a base member mounted on the palm side of said glove body and provided on the upper surface with teeth, said teeth including rectangular hill portions and rectangular valley portions of larger size than the rectangular hill portion, a wing member having one edge extending longitudinally to said base member and provided on the lower surface with teeth having rectangular hill portions and rectangular valley portions of larger size than the rectangular hill portions which are engaged with the teeth of said base member, and a rope guide concave in cross-section are adapted for positioning a rope in the center portion of the upper surface in the rectangular hill portions of the teeth of the base member and wing member.

2. The escapement glove according to claim 1, wherein the underside of said base member mounted on the palm side of said glove body is curved, said wing member pivoted to said base member has a wavy grip surface formed at the top and has a cover portion extending from an edge, and said base and wing members define a substantially cylindrical shape when said two members are overlapped over each other.

3. The escapement glove according to claim 1, wherein said base member is provided to the upper end and lower end with rope guide rings corresponding to the rope guide concave formed in the upper surface of the teeth of the base member and wing member.

* * * * *